US005901718A

United States Patent [19]

Morimoto et al.

[11] Patent Number: 5,901,718

[45] Date of Patent: May 11, 1999

[54] WASH TANK FOR SMALL MOLDED PARTS

[75] Inventors: Ryoichi Morimoto, Akaiwa-gun; Ikuo Ueda; Yasuo Ohnishi, both of Okayama, all of Japan

[73] Assignee: Kuraray Engineering Co., Ltd., Kurashiki, Japan

[21] Appl. No.: 08/824,751

[22] Filed: Mar. 26, 1997

[51] Int. Cl.[6] ..... B08B 3/02; B08B 3/04

[52] U.S. Cl. ..... 134/120; 134/182

[58] Field of Search ..... 134/133, 182, 134/104.3, 186, 191, 120; 366/136, 137, 167.1, 171.1; 68/189, 184, 187, 194; 141/5, 98; 210/232, 720, 601

[56] References Cited

U.S. PATENT DOCUMENTS

| | | | |
|---|---|---|---|
| 2,365,293 | 12/1944 | Robinson | 366/136 |
| 3,276,753 | 10/1966 | Solt | 366/136 |
| 3,797,262 | 3/1974 | Eigenbrod | 141/5 |
| 4,197,016 | 4/1980 | Winterhalter | 134/182 |
| 5,735,600 | 4/1998 | Wyness | 366/137 |

FOREIGN PATENT DOCUMENTS

| | | |
|---|---|---|
| 55-124580 | 9/1980 | Japan . |
| 59-123580 | 7/1984 | Japan . |
| 61-263682 | 11/1986 | Japan . |

*Primary Examiner*—Philip R. Coe
*Assistant Examiner*—Paul J. Lee
*Attorney, Agent, or Firm*—Oblon, Spivak, McClelland, Maier & Neustadt, P.C.

[57] ABSTRACT

To provide a wash tank which is excellent in washing effect with a simple structure, compact, highly practical and effective in washing small molded parts made of rubber or plastic, the wash tank includes a sealable lid having a washing fluid outlet, a conical bottom wall portion having a washing fluid inlet and a cylindrical side wall portion, having a draft tube in a bugle-like shape a bottom end and an upper end of which are expanded and which is disposed at the inside of the tank and a partition plate arranged at a front face of the draft tube and further provided with a jet stream nozzle at a washing fluid inlet portion where the tank is constituted reversibly.

6 Claims, 4 Drawing Sheets

VIEW FROM THE DIRECTION
SHOWN BY THE ARROWS

WASH TANK FOR SMALL MOLDED PARTS

BACKGROUND OF THE INVENTION

1. Field of the Invention

The present invention relates to a wash tank for efficiently washes, sterilizes and dries small molded parts made of rubber or plastic requiring a high degree of washing, for example, molded parts of various rubber stoppers or medical joints. The wash tank of the present invention is particularly effective in washing small molded parts such as a rubber stopper for a stopper used as a plug of a medicine phial for drug, liquid medicine or the like, a rubber part in a complicated shape having air vent holes such as a rubber stopper for fluid therapy, a plastic joint for a blood circuit or the like.

2. Related Art of the Invention

There have been known as generally performed conventional methods of washing small molded parts such as a rubber stopper for a medicine phial and the like, an agitation washing process where articles to be washed (hereinafter, referred to as washed objects) are only dipped in water, agitated and washed, a high pressure jet washing process where high pressure jet is blown, a pulsation washing process where washing is conducted by generating pulsation of air from a distributor having a double mesh structure (Japanese Patent Laid-open No. Sho 55-124580/1980), an ultrasonic wave washing process where washed objects are stored in an ultrasonic wave cleaner and washed by ultrasonic wave, or the like.

However, it is difficult to make flow a washing solution uniformly only by dipping washed objects in water or a liquid medicine and agitating them and therefore, there is a concern what wash specks are liable to cause, articles are damaged by a friction therebetween or exfoliated foreign objects are re-adhered to articles and a satisfactory washing effect has yet to achieve.

Further, even with a rubber stopper, when articles are provided with a complicated shape having air vents such as a rubber stopper for a half stopper or a rubber stopper for fluid therapy or the like, fine portions such as recessed portions or inner surfaces of small holes are difficult to wash. Even with the high pressure jet washing process, when a large amount of molded articles are washed in one operation, the jet stream is not made to blow uniformly to all of the articles and the uniform washing is difficult even with a single article since the degree of impingement of a jet stream is distributed and further, fine bubbles under the skin, a small amount of air adhered to a coarse surface or the like cannot be completely removed.

Furthermore, with respect to the ultrasonic wave washing process, when the washed object is an elastic article such as a rubber stopper, a sound wave is absorbed by the soft face whereby almost no washing effect is achieved. Also, with respect to the pulsation washing process utilizing the pulsation of air, a distributor for generating the pulsation of air is installed at a lower portion of a washer and therefore, when the specific weight of the washed object is small, the washed objects aggregate at upper portion of a washer whereby the washing effect is not sufficient and other washing system has to be used. As described above, it is the actual current situation that the satisfactory washing effect has not been achieved by any processes in washing various small molded articles made of rubber or plastic requiring a high degree of washability accordingly, a wash tank capable of efficiently washing objects by using a single tank and further capable of conducting sterilization and drying by using the same tank irrespective of a difference in materials of washed objects or magnitude of the specific weight has been desired. There have been various conventional rubber products the materials of which were brittle and where the rubber stopper per se was damaged by a jet stream and contamination frequently occurred. However, in recent times the rubber quality is improved and the jet stream washing becomes applicable. In view of the situation, the inventors have invented a washing device having a draft tube the upper end and the lower end of which are expanded for resolving the above-described problems and applied for a patent as Japanese Application No. Sho 57-229881/1982. According to the device, foreign objects are effectively exfoliated by circulating washed objects at the outside and the inside of the draft tube whereby the washed objects can uniformly be washed One of the inventors invented a washing device where a cylindrical rotary drum is disposed in a sealed vessel to carry out further effective washing and applied for a patent as Japanese Application No. Sho 60-104736/1985. This device is a washing device having a cylindrical rotary drum in a sealed vessel which utilizes a jet stream generated in the rotary drum by a water jet pump.

However, the device described in Japanese Application No. Sho 57-229881/1982, has only the washing function and although the washing effect is significant when the specific weight of a washed object is large, a sufficient washing effect is not achieved when the specific weight is small. Meanwhile, with respect to the washing device described in Japanese Application No. Sho 60-104736/1985 sealing of rotary portions is indispensable since the rotary drum is disposed in the sealed vessel and the occurrence of foreign objects by dislodged abrasion of the rotating portions or invasion of foreign objects from a mechanical seal portion or the like is not totally dispensed with. Furthermore, as mentioned above, the device per se is complicated and the device is magnified whereby too much cost is imposed in manufacturing thereof. Accordingly, it is an object of the present invention to provide a highly practical wash tank of a compact type with no concern of occurrence or invasion of foreign objects where the washing effect is excellent irrespective of the magnitude of the specific weight of washed objects and the structure is simple and where also sterilization and drying can be conducted by using the same tank.

SUMMARY OF THE INVENTION

The inventors have conducted an intensive study in order to attain the above-mentioned object and achieve the present invention. The present invention is a wash tank including a sealable lid having a washing fluid outlet, a conical bottom wall portion having a washing fluid inlet and a cylindrical side wall portion, having a draft tube a lower end and an upper end of which are expanded in a bugle-like shape at the inside of the tank and a partition plate arranged at a front face of the draft tube and further provided with a jet stream nozzle disposed at a washing fluid inlet portion of the tank where the tank is reversibly constituted.

There is no rotating portion inside of the invented wash tank and therefore, there is no occurrence or invasion of foreign objects. Further, according to the invented wash tank, a high washing effect can be achieved by a synergistic effect of a jet stream from the jet stream nozzle installed at the washing fluid inlet portion and the draft tube installed inside of the washing tank. Furthermore, the tank is constituted reversibly and therefore, supply, washing, sterilizing, drying and discharging of rubber stoppers and the like can reasonably be executed and further, the wash tank is similarly applicable even if the specific weight of the washed object is smaller than that of a washing solution by using the tank reversibly.

According to the wash tank of the present invention, when the diameter of a washed object is designated by notation d, the inner diameter of the draft tube is set to 6d through 14d.

Further, according to the wash tank of the present invention, the inner diameter of the wash tank is set to 4 through 7 times as large as the inner diameter of a straight tube portion of the draft tube.

DETAILED DESCRIPTION OF THE PREFERRED EMBODIMENTS

Figure 1:
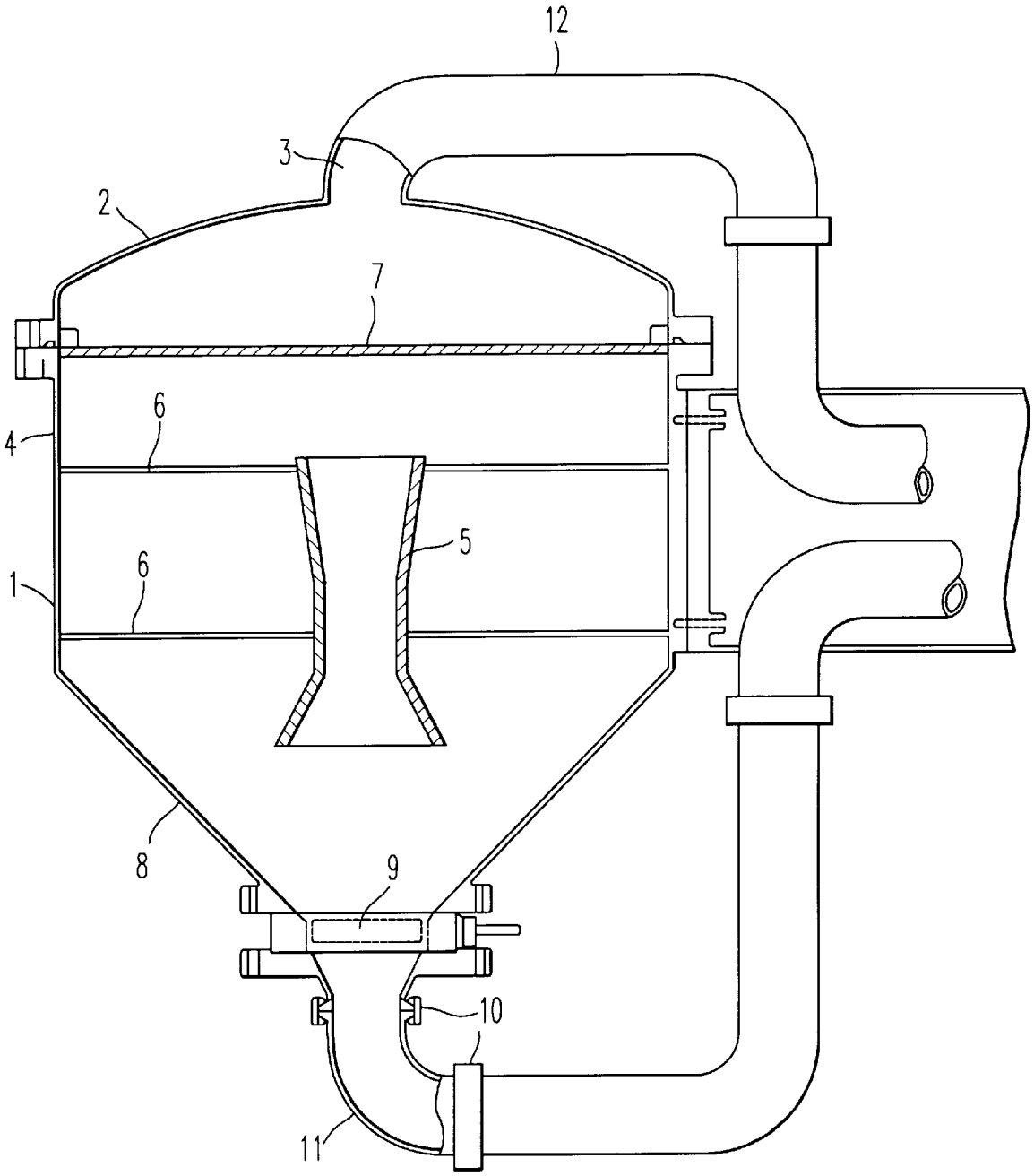
FIG. 1 is a sectional view showing an embodiment of a wash tank according to the present invention.

An explanation will be given of an embodiment of a wash tank according to the present invention in reference to the drawings as follows. FIG. 1 is a sectional view of a wash tank of the present invention. In FIG. 1, numeral 1 designates a wash tank. Numeral 2 designates a sealable lid having a washing fluid outlet 3, which is tightly fastened to a main body of the tank by fixing members such as bolts. Numeral 4 designates a cylindrical side wall portion where a supporter 6 for supporting a draft tube 5 provided at the inside of the tank and the ends of which are expanded in a bugle-like shape, is installed. The supporter may be in a simple rod-like shape, may be a radial support plate or the like which is not particularly limited so far as it firmly supports the tube.

Although the side wall portion is normally formed in a cylinder, it may be formed in a more or less modified cylindrical shape so far as it is formed in a shape whereby fluid flow in the tank is symmetrical in respect of central axes of the tank and the draft tube. Also, the side wall portion may not be in a cylindrical shape but may be in a shape where the conical bottom wall portion is extended continuously to the top of the tank. In this case, the midway of the side wall portion may be bent once or several times in view of adjusting an intermediary between the lower expanded portion of the draft tube and the side wall portion and also in view of the design. Numeral 7 designates a partition plate comprising a net, a perforated plate or the like for preventing washed objects from flowing out.

Figure 2:
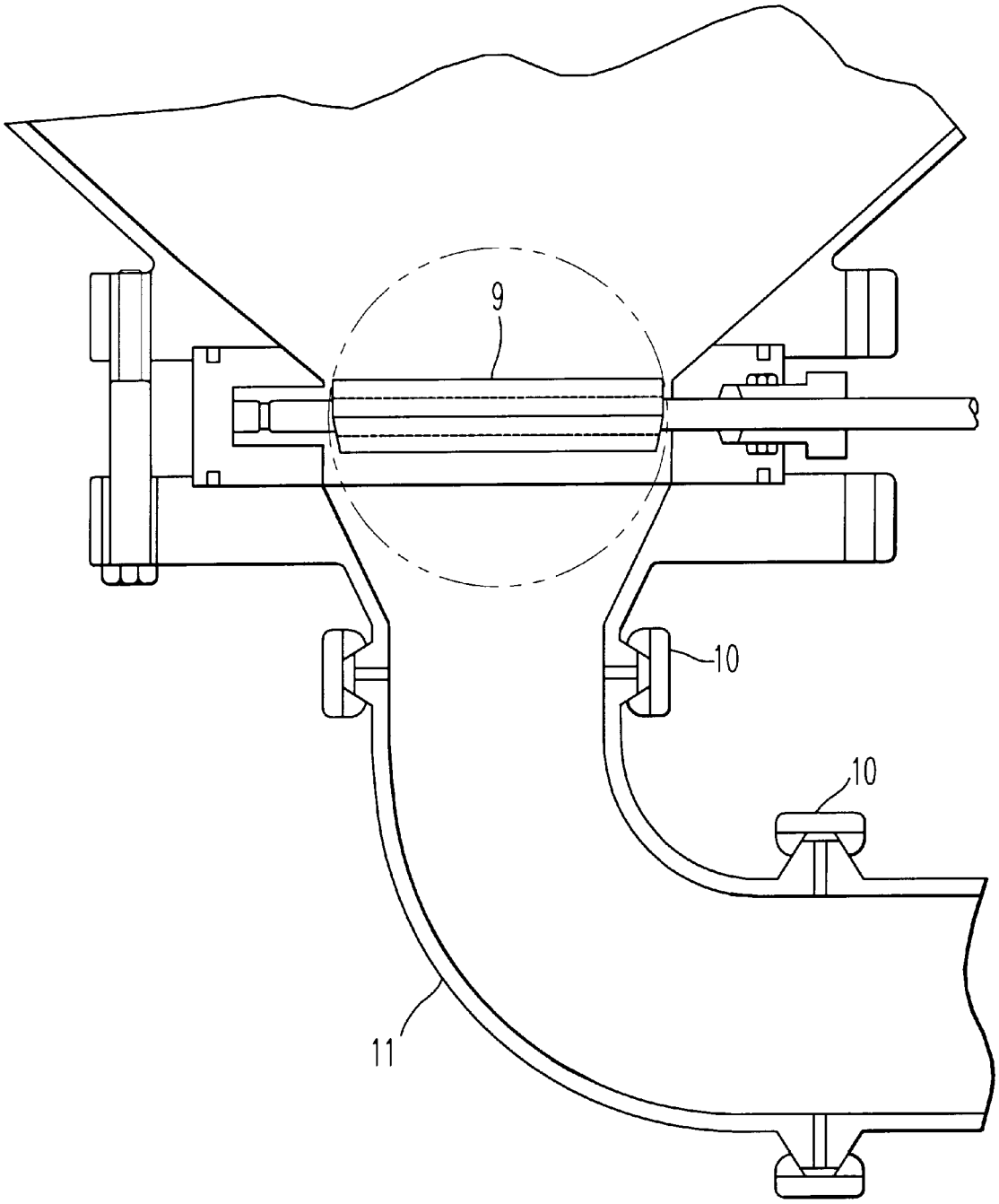
FIG. 2 is an enlarged view of an embodiment of a jet stream nozzle used in the wash tank of the present invention.

Numeral 8 designates a conical bottom wall portion where a jet stream nozzle 9 is installed at the apex of the cone. Although the bottom wall portion is preferably provided with a complete cone shape, it may be formed in a shape in a conical state in the broad sense of the shape. The jet stream nozzle 9 is constituted as a circular gap or perforations arranged in a circle on a disk. FIG. 2 is an enlarged view when a circular gap is formed between a valve having a shape of a butterfly valve and a casing. Although the gap is determined such that the jet stream impinges uniformly on washed objects, a washing fluid is circulated at the inside and the outside of the draft tube 5 and washed objects are carried by the circulation flow and are prevented from passing through the gap, and further in accordance with required washing degree of washed objects, it is generally preferable that the gap is set such that the jet speed from the nozzle portion becomes 2 m through 20 m per second. The gap is normally set to about 0.5 mm through 3 mm.

Figure 3A:
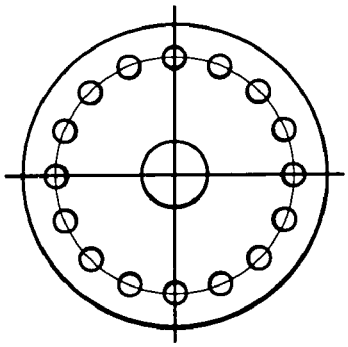
FIG. 3 illustrates enlarged views of an embodiment of a jet stream nozzle used in the wash tank of the present invention.
Figure 3B:
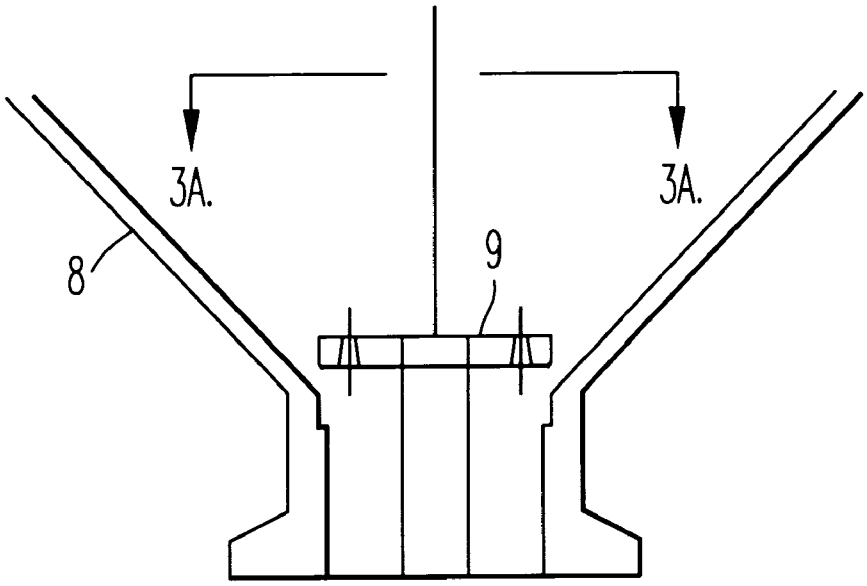

A jet stream nozzle illustrated by FIG. 3 shows an example of a perforated nozzle installed along the periphery of a disk at equal intervals where the disk is pressed in the axial direction toward the apex of the bottom wall of the wash tank by a pneumatic cylinder or the like during the washing operation and a washing solution is injected from the nozzle portion. As described above, the diameter of a single hole constituting the nozzle is set to produce the above-described jet speed such that the jet stream impinges uniformly on washed objects, the washing fluid is circulated at the inner side and the outer side of the draft tube 5 and washed objects are made to flow by being carried by the circulation flow. The diameter of the nozzle hole is normally set to about 3 mm through 5 mm.

It is one feature of the present invention to use such a jet stream nozzle whereby an excellent flowing state where foreign objects are well exfoliated and the jet stream impinges uniformly on washed objects by the synergistic effect of the jet stream nozzle, the draft tube which is provided at the inside of the tank and the upper end and the lower end of which are expanded in a bugle-like shape and the partition plate arranged in front of the draft tube, is created by which a high washing effect is achieved.

It is preferable in view of the washing effect to align the central axis of the inlet portion of the washing fluid where the jet stream nozzle is installed and the central axis of the draft tube the ends of which are expanded in a bugle-like shape. The jet stream port of the nozzle is preferably provided on the side of the center from a half of the inner diameter of a straight tube portion of the draft tube with a reference of the central axis of the straight tube portion of the draft tube. By constituting the jet stream port of the jet stream nozzle in this way, the washing fluid is made to flow toward the expanded portion in a bugle-like shape (on the side where the washing solution is made to flow in) with small energy loss and efficiently from the outside of the draft tube to the inside of the draft tube by which the flow speed and the amount of flow of a combined flow of the jet stream inside of the draft tube and the circulation flow can be increased whereby the washing effect can be promoted.

Although washed objects are generally provided with various shapes, when the volume of the washed object is defined as v, the diameter d of the washed object can be expressed by an equivalent diameter for a sphere designated by $(6\ v/\pi)^{1/3}$. It is preferable according to the invented wash tank that the inner diameter of the straight tube portion of the draft tube ranges 6d through 14d since the washing effect is promoted. Further, it is preferable in view of promoting the washing effect and manufacturing a compact washing tank that the inner diameter of the washing tank is 4 through 7 times as large as the inner diameter of the straight tube portion of the draft tube. It is preferable in view of preventing the washed objects from blocking and smoothly carrying out circulation that a gap between the expanded portion of the draft tube and the bottom wall portion is spaced by 3*d* or more.

Numeral 10 designates a clamp for attaching and detaching a bend 11 for discharging products after washing. The washed objects can naturally be put into the wash tank or taken out therefrom by closing or opening the jet stream nozzle.

Although various sizes of the wash tank can be manufactured in accordance with the amount of the processed washed objects, the size of about 0.1 $m^3$ through 2 $m^3$ is easy to handle and practical. Further, the filling factor of the washed objects is normally in a range of 30% through 60%. Incidentally, when a peep hole is installed to a wash tank, the inner state of washing can be confirmed, which is preferable in view of the operation.

Although sterilized water, filtered water, distilled water, purified water, UF water, RO water or the like is used as the washing fluid, steam can also be used for sterilization and air can be used for drying. The washing fluid may also by heated in order to enhance the washing effect.

Figure 4:
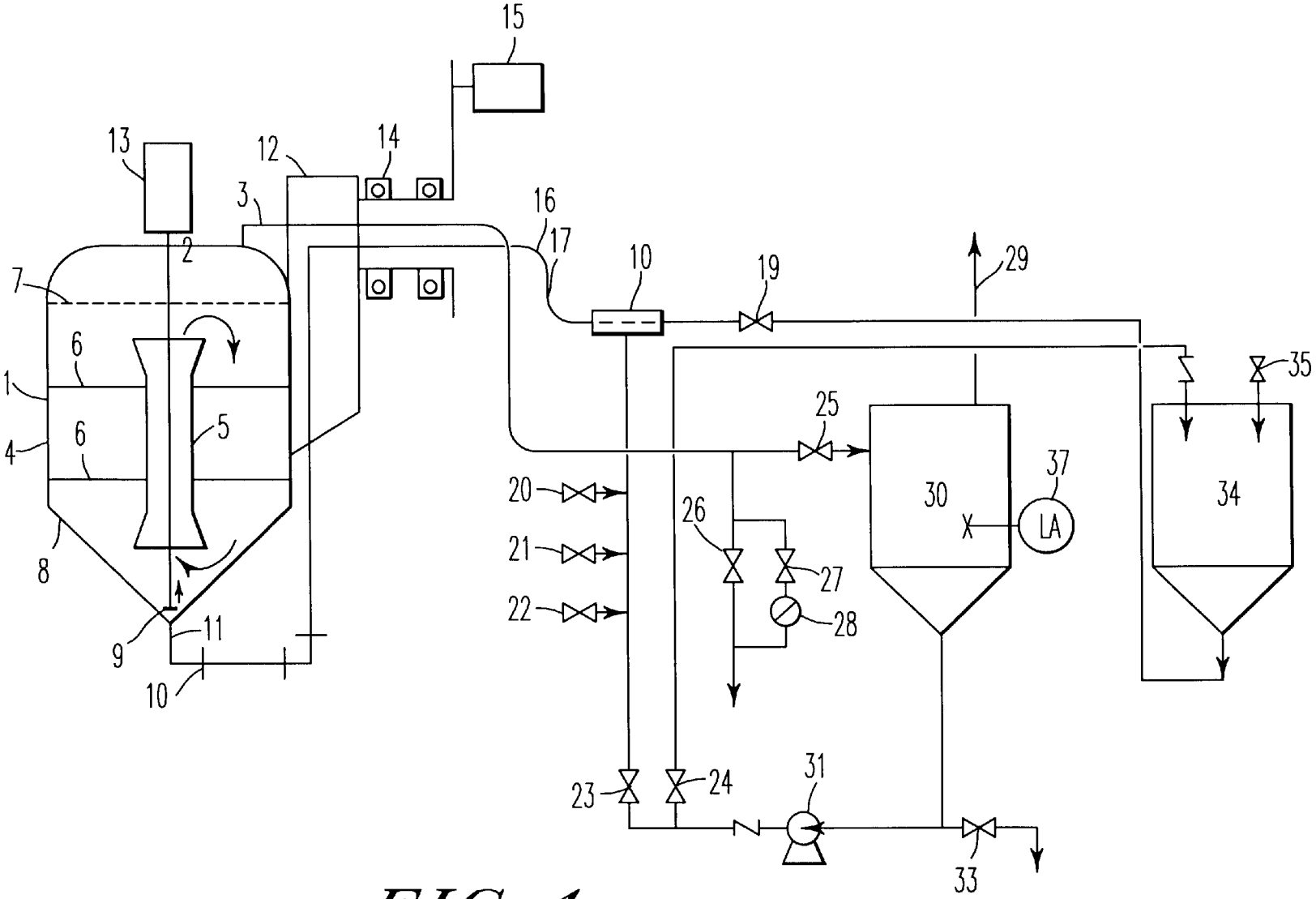
FIG. 4 is a flow sheet of an example when washing is carried out by using the wash tank of the present invention.

FIG. 4 is a flow sheet when washed objects are washed, sterilized and dried by using the wash tank of the present invention. A system using the wash tank of the present invention, is constituted by the wash tank of the present invention, a separation tank for storing a washing fluid, a charging tank for charging a slurry of the washed objects and the washing fluid into the washing tank, a vacuum pump, not illustrated, for bringing the inside of the tank under a reduced pressure, and a circulation pump for circulating the washing fluid. Further, a washing fluid inlet piping and a washing fluid outlet piping pass through the inside of a hollow shaft for reversing the tank and the total of the washing tank is provided with a structure that is reversible and pivotable in directions in which the tank is rotatable under a state where the wash tank is positioned regularly or reversibly. The regularly positioned state of the wash tank refers to the state of the washing tank illustrated by FIG. 4 and the reversely positioned state refers to a state where the tank is rotated upside down from the state of FIG. 4. FIG. 1 through FIG. 3 show the regularly positioned state. The jet stream nozzles in FIG. 3 are derived from the example of the perforated nozzle installed along the periphery of the disk at equivalent intervals.

Next, an explanation will be given of the method of using the wash tank of the present invention in washing, sterilizing and drying washed objects in reference to the flow sheet of FIG. 4.

(1) Preparation of Washing

Washed objects and transport water from a transport water supply valve 35 are put into a charging tank 34 whereby the inside of the charging tank is made into a slurry state. A pneumatic cylinder 13 is operated, the disk pressed to the apex of the bottom wall of the wash tank is opened, successively a motor 15 is operated and the washing tank 1 is rotated upside down from the state of FIG. 4.

A valve 19 on the slurry transport pipe, a wash water supply valve 20, a sterilization steam supply valve 21, a drying air supply valve 22, a washing fluid circulation valve 23, a washing fluid discharge valve 26, a drain discharge valve 27, a separation tank discharge valve 33 and the transport water supply valve 35 are closed and the wash tank and separation tank routes are brought into a reduced pressure state through a vacuuming line. The valve 19 on the slurry transport pipe is opened, and the slurry in the charging tank 34 is put into the wash tank 1 via an aggregation pipe 18 by using a pressure difference between the charging tank 34 and the wash tank 1. The aggregation pipe 18 uses a double tube having an inner tube with a net-configuration such that the slurry can pass through the central portion, fluids which are washing and transport water, sterilizing steam, drying and water evacuation air can pass therethrough from the surrounding and washed objects can not pass therethrough on the outer side since solid, liquid and gas need to pass therethrough.

When the slurry in the charging tank 34 cannot be transported to the wash tank 1 in one operation, an operation of returning the transport water drawn to a separation tank 30 via the partition plate 7 installed in the wash tank and a washing solution outlet tube 12, back to the charging tank 34 by opening a transport water return valve 24 and operating a circulation pump 31, may be repeated. After putting the slurry into the wash tank 1 and releasing the negative pressure of the system, water is discharged by opening a water solution discharge valve 26 and the separation tank discharge valve 33. Next, the disk-like lid forming the jet stream nozzle is pressed to the apex of the bottom wall of the wash tank by operating the pneumatic cylinder 13 and the wash tank 1 is recovered to the regularly positioned state.

(2) Washing

Opening and closing of respective valves is confirmed, water is supplied from the wash water supply valve 20, the wash tank 1 is filled up, water is supplied while confirming by a liquid level meter 37 until overflow water reaches a predetermined liquid level of the separation tank 30 and the circulation pump 31 is operated whereby the washing liquid is circulated. A filter may be installed at the back side of the circulation pump 31 as necessary. It is convenient for confirmation of the situation at the preparatory stage, as a guide in the steady-state operation, for detection of abnormality or the like to install a pressure gage, a thermometer, and a peep hole for observing the inside of the wash tank and the like to the wash tank 1 other than the liquid level meter 37 of the separation tank. In the steady-state operation, a circulation flow circulating the inside and the outside of the bugle-like draft tube is created as shown by FIG. 4 and whether washed objects are being preferably washed can be confirmed by a peep hole. Although the wash time is not particularly limited, the washing is normally carried out for 5 through 20 minutes.

When the specific weight of washed objects is larger than that of the washing fluid, the washing is conducted by carrying washed objects on the circulation flow at the inside and the outside of the bugle-like draft tube where the wash tank is at the regularly positioned state. Further, when the specific weight of washed objects is smaller than that of the washing fluid (when washed objects are floated), the washing is conducted by carrying washed objects on the circulation flow at the inside and the outside of the bugle-like draft tube where the wash tank is set to the reversed state. In this way, the wash tank of the present invention is applicable irrespective of whether the specific weight of washed objects is larger or smaller than that of the washing fluid. Especially, when the specific weight of washed objects is smaller than that of the washing fluid, the washing operation comparable to that in the case where the specific weight is larger can be conducted by using the wash tank in the reversely positioned state.

It is also possible that supply and discharge of water are simultaneously conducted while washing washed objects, rinsing is continuously conducted or new water is supplied after stopping the circulation and discharging water by setting the tank to the reversely positioned state, water is filled up, the wash tank is recovered to the regularly positioned state and thereafter, rinsing is conducted by circulating water again.

It is preferable to pivot the total of the wash tank intermittently or continuously in the washing operation since the uniformity of washing is further promoted. The pivoting operation is conducted by constituting rotatably the hollow shaft where the inlet piping and outlet piping of the washing fluid pass through by using a rotational bearing 14 such as a bearing or the like and operating the motor 15.

Although the pivoting angle is not particularly limited, it is preferable in view of high washing effect and low energy consumption to pivot the wash tank in a range of ±40 through 50 degrees with the reference of the regularly positioned state or the reversely positioned state. The pivot angle may be controlled by attaching, for example, a disk to a rotating shaft, setting a through hole at a predetermined position on the disk and detecting the through hole at the set position by a photoelectric tube. It is preferable that portions of pipings are constructed by flexible tubes to prevent destruction of the pipings and to pivot the wash tank smoothly. Numerals 16 and 17 designate such flexible tubes.

After conducting the washing operation for a predetermined time, the circulation pump 31 is stopped. The wash tank 1 is reversed by operating the motor 15 and thereafter, the solution in the wash tank is drawn out to the separation tank 30 from a washing fluid outlet valve 25 via the washing fluid outlet tube 12. Further, the solution in the separation tank 30 is drawn out of the system from the separation tank discharge valve 33. Water is discharged by pushing out water by supplying air by opening the drying air supply valve 22. In the discharge operation, the wash tank is pivoted and water is discharged such that drops of water on washed objects remain to a minimum possible degree.

(3) Sterilization

In order to sufficiently discharge the water and effectively carry out the sterilization operation, the valves 19 and 22 are closed while holding the wash tank 1 in the reversely positioned state and water is discharged outside of the system from the vacuum line 29. At this time, it is further effective to pivot the wash tank. After sufficiently taking water off, the vacuum line 29 is closed, and the valve 25 is closed, the sterilization steam supply valve 21 is opened by which steam is introduced into the wash tank, air in the tank is replaced by the sterilization steam, then the drain discharge valve 27 is opened, the temperature is elevated to a predetermined temperature and thereafter, the sterilization operation is conducted for a predetermined time period.

The sterilization operation is executed continuously for 20 minutes while holding the temperature of 121 degrees centigrade for conducting the moist heat sterilization. Steam drain is discharged outside of the system from a steam trap 28. It is effective to pivot the total of the wash tank intermittently or continuously in order to conduct the sterilization operation uniformly. Although the temperature is lowered since drain sticks on sterilized objects in the sterilization operation, the drain flows down effectively by the pivoting operation thereby preventing the lowering of the temperature and sterilization can be conducted at a further uniform temperature. Moreover, the reduction of remaining water contributes significantly to shortening of drying time to take water off to a minimum possible degree by the pivoting operation since a large amount of heat is dissipated by reevaporation of remaining drain after finishing the sterilization operation.

(4) Drying

Drying air is introduced to the wash tank in the reversely positioned state from the drying air supply valve 22 and discharging air out of the system by opening the washing solution discharge valve 26. The drying operation is further effective when reduced pressure drying or vacuum drying operation which conducts the drying operation by closing the valve 26, opening the valve 25 and forcibly discharging air by a vacuum pump or the like, from the vacuum line 29. It is further effective to pivot the wash tank intermittently or continuously in order to carry out the drying operation uniformly.

Water adhered to washed objects and the inside of wash tank and remaining water inside of washed objects can be evaporated by heat remaining after the sterilization operation in the early stage of the drying operation and can effectively be discharged outside of the system by using low dew point air as the drying air, lowering the equilibrium moisture content in the tank by forcibly discharging air by a vacuum pump, or heating the wash tank from outside by steam or the like whereby drying operation can be accelerated.

(5) Discharge of Products

After finishing the drying operation, the wash tank 1 is recovered to the regularly positioned state, the clamp 10 is removed, the bend 11 at the washing fluid inlet portion is removed and the jet stream nozzle 9 in a shape of a butterfly valve is pivoted by 90 degrees when the jet stream nozzle illustrated by FIG. 1 is used. Further, when the jet stream nozzle illustrated by FIG. 3 is used, the bend 11 is removed, the valve constituting the jet stream nozzle 9 is pulled up by operating the pneumatic cylinder 13, products tumble down on the slope of the cone and are discharged from the discharge port and the products are received by a product container. It is preferable to discharge products in a clean room to prevent recontamination of the products. It is naturally necessary in this case that the product container is cleaned by washing, sterilizing and drying it.

The wash tank having the jet stream nozzle is provided by the present invention. When rubber stoppers for stoppers used as plugs for medicine phials of drug or medicine liquid or the like, rubber parts in a complicated shape having air vents or the like such as rubber stoppers for fluid therapy or small molded parts such as plastic joints for blood circuits, are washed by using such a wash tank, the washing operation can be carried out uniformly by the synergistic effect of the jet stream of washing fluid from the jet nozzle and the circulation thereof by the draft tube installed inside of the wash tank and the washing effect is extremely promoted. Further, the structure of the wash tank of the present invention is simple and applicable to products sinking down in the washing fluid due to the large specific weight and products floating in the washing fluid due to the small specific weight, the manufacturing cost is inexpensive since the device is made compact and the device is highly practical. Further, the structure of sterilization and drying routes is simple and hygienic control can easily be conducted.

What is claimed is:

1. A parts washing tank comprising:

a lid having a washing fluid outlet;

a conical bottom wall portion having a washing fluid inlet;

a cylindrical side wall portion;

means for sealing said lid with respect to said cylindrical side wall portion;

a draft tube with a lower end and an upper end which are expanded in a bugle-like shape, said draft tube being disposed at an inner portion of the wash tank;

a partition plate arranged between the draft tube and said fluid outlet for preventing the parts from flowing out of the tank;

a jet stream nozzle disposed at a washing fluid inlet portion; and means for pivoting the wash tank during operation.

2. A wash tank according to claim 1, wherein an inner diameter of said draft tube is 6d through 14d where d designates a diameter of a washed object.

3. A wash tank according to claim 1, wherein an inner diameter of said wash tank is 4 through 7 times as large as an inner diameter of a straight tube portion of the draft tube.

4. A wash tank for washing small molded objects, comprising:

a conical bottom wall portion having a washing fluid inlet;

a cylindrical side wall portion;

a lid having a washing fluid outlet, said lid configured to form a seal with respect to said cylindrical side wall portion;

a draft tube with a lower end and an upper end which are expanded in a bugle-like shape, said draft tube being disposed within an inner portion of the wash tank;

a jet stream nozzle disposed at a washing fluid inlet portion; and a partition plate arranged between the draft tube and said fluid outlet for preventing the parts from flowing out of the tank;

wherein the wash tank is integrated with a hollow shaft through which a washing fluid inlet pipe and a washing fluid outlet pipe are passed, said hollow shaft equipped with a pair of rolling bearings such that said wash tank is capable of reversing and swinging during operation;

wherein the wash tank is constituted in such a manner that washing fluid, sterilizing steam, and drying air are supplied to the wash tank.

5. A wash tank according to claim 4, wherein an inner diameter of said draft tube is 6d through 14d where d designates a diameter of a washed object.

6. A wash tank according to claim 4, wherein an inner diameter of said wash tank is 4 through 7 times as large as an inner diameter of a straight tube portion of the draft tube.

* * * * *